United States Patent [19]

Fauls

[11] 4,179,842

[45] Dec. 25, 1979

[54] AUDIBLE SOUND EMITTING TOY

[75] Inventor: Thomas J. Fauls, West Orange, N.J.

[73] Assignee: Mego Corp., New York, N.Y.

[21] Appl. No.: 827,933

[22] Filed: Aug. 26, 1977

[51] Int. Cl.[2] ..... A63H 5/00

[52] U.S. Cl. ..... 46/117; 46/44; 274/1 A

[58] Field of Search ..... 46/117, 232, 169 R, 46/175 R, 44; 274/1 A

[56] References Cited

U.S. PATENT DOCUMENTS

| | | | |
|---|---|---|---|
| 3,475,856 | 11/1969 | Cowell et al. | 274/1 A |
| 3,495,351 | 2/1970 | Bear et al. | 46/232 X |
| 3,538,638 | 11/1970 | Glass et al. | 46/117 X |
| 3,600,845 | 8/1971 | Mendigal | 46/44 |
| 3,620,538 | 11/1971 | Mercer et al. | 274/1 A |
| 3,755,960 | 9/1973 | Tepper et al. | 46/232 X |
| 3,916,561 | 11/1975 | Kato | 46/169 R |

*Primary Examiner*—Russell R. Kinsey
*Assistant Examiner*—Mickey Yu
*Attorney, Agent, or Firm*—Bertram Frank

[57] ABSTRACT

A toy such as a doll which is capable of alternately emitting one of a plurality of different audible sounds, depending on the orientation of the toy, i.e., each sound corresponds to a different orientation of the toy. Typically when the toy is a doll, the doll emits the sound of giggling or laughter when in the upright vertical position and the sound of crying when in the reclining horizontal position. At least a portion of the interior of the toy is hollow, and an arrangement is provided within the hollow interior capable of alternately emitting at least two audible sounds. A pivoted weight and a switch arrangement are disposed in the hollow interior of the toy, the switch arrangement being connected with the pivoted weight and with the arrangement for emitting sound. The pivoted weight moves to alternate positions when the orientation of the toy is changed, so that a change in the relative position of the pivoted weight causes the switch arrangement to controllably change the audible sound emitted by the arrangement for alternately emitting at least two different audible sounds.

11 Claims, 11 Drawing Figures

AUDIBLE SOUND EMITTING TOY

BACKGROUND OF THE INVENTION

1. Field of the Invention

An audible sound emitting toy.

2. Description of the Prior Art

Toys such as dolls which emit audible sounds provide a great deal of enjoyment for children, because of the simulation of a real-life baby, person or character of fiction to which the child can readily relate. A simple form of such a toy is one in which a sound is emitted when the toy is squeezed, in which case air is forced through means such as a whistle mounted in the body of the toy. Prior art relating to such pneumatic toys includes U.S. Pat. Nos. 2,616,217; 2,712,201; 2,745,214; 2,819,558; 2,928,208; and 3,075,317; British Pat. No. 814,021; and French Pat. Nos. 1,031,489; 1,038,887 and 1,171,083.

Other toys rely on the winding of a spring-motor, e.g. by the turning of a key or by the pulling of a string, cord or wire by the child, to wind up and/or actuate the sound-producing unit which is usually a toy phonograph within the body of the toy. Prior art of this nature includes U.S. Pat. Nos. 3,165,320; 3,261,124; 3,282,588; 3,298,130; 3,315,406; 3,600,848; 3,636,654; 3,636,655 and 3,859,749; and French Pat. No. 1,104,910.

More sophisticated devices have been recently developed in which an electrically operated unit is installed in the toy to emit a sound. Usually the unit is battery-operated and the sound is emitted by throwing a switch. Prior art relative to such a unit includes U.S. Pat. Nos. 3,467,393 and 3,589,735, and Japanese Pat. No. 793,915.

SUMMARY OF THE INVENTION

1. Purposes of the Invention

It is an object of the present invention to provide an improved audible sound emitting toy.

Another object is to provide such a toy which is capable of alternatively emitting one of a plurality of audible sounds, each sound corresponding to a different orientation of the toy.

An additional object is to provide a toy doll which emits the sound of laughter and/or giggling when in the upright vertical position, and the sound of crying when in the reclining horizontal position.

A further object is to provide an audible sound emitting toy which emits different sounds in different positions.

Still another object is to provide such a toy with integral time delay means with respect to the emission of at least one sound.

Still a further object is to provide such a toy in the form of a doll, with integral means to open or close the eyes of the doll in accordance with the particular orientation of the doll.

An additional object is to provide an audible sound emitting toy which relies on integral air-actuated mechanical means for time delay with respect to the emission of at least one sound and also with respect to a change in the position of a member such as a lid over a recess.

These and other objects and advantages of the present invention will become evident from the description which follows.

2. Brief Description of the Invention

In the present invention, an improved audible sound emitting toy is provided in which the toy is capable of emitting a plurality of audible sounds, each sound corresponding to a different orientation of the toy. The toy is characterized by the provision of an enclosure which is at least a portion of the toy. At least a portion of the interior of the enclosure is hollow, i.e. a hollow toy is contemplated. At least a portion of the enclosure adjacent or surrounding the hollow interior portion is foraminous, to permit the egress of sound from the hollow interior portion of the toy, in which portion is disposed suitable means to alternately emit at least two different audible sounds. A pivoted weight and switch means are provided within the hollow interior portion of the enclosure. The switch means is connected with the pivoted weight and with the means to alternately emit at least two different audible sounds. The pivoted weight moves to an alternate position when the orientation of the toy is changed, so that a change in the relative position of the pivoted weight causes the switch means to controllably change the audible sound emitted by the means to alternately emit at least two different audible sounds.

The toy is preferably a doll, in which case the enclosure is typically the torso of the doll. When the toy is a doll, generally the first orientation of the doll will be an upright vertical position and the second orientation of the doll will be a reclining horizontal position. In this case, typically the doll will emit the simulated sounds of giggling or laughter, resembling the sounds of an actual baby when held and petted, when in the upright vertical position. When in the alternative reclining horizontal position, the doll typically will emit the sounds of crying, preferably after a delay of a time interval, such as 30 seconds, attained by the provision of time delay means in the structure, as will appear infra. Thus, in this preferred embodiment, the child playing with the doll is led to believe and feel that a true simulation of a real baby is attained, i.e. a baby that needs the constant care and attention of the child. This effect is attained since, when the doll is placed in a toy cradle or the like so that the doll is in the horizontal position, the doll starts to cry, typically after a time interval. Thus the child is led to pick up the doll, and hold the doll in her arms, or upright in a vertical position, or even against her shoulder, for cuddling, comforting, coddling, and care in general, at which point the doll emits simulated sounds of giggling, cooing and/or laughter to show happiness. The sequence is repeated when it is time for the child to put the doll to sleep again in the cradle. Within the context of the present invention, it will be understood that the term giggling encompasses and includes cooing, laughter and other gleeful sounds.

Any suitable means known to the art may be provided within the hollow interior of the toy to alternately emit at least two different audible sounds. Such means preferably is of the character described in U.S. Pat. Nos. 3,467,393 and 3,589,735, and Japanese Pat. No. 793,915, which described means are typically battery-operated, however, pneumatic or spring-motor operated means to alternately emit at least two different audible sounds are also contemplated as being within the scope of the present invention.

In a preferred embodiment, the pivoting of the weight is attained by mounting the weight on a pivoted beam. In this case, suitable means may be provided to alternately open and close a lidded recess such as an eye socket in conjunction with motion of the pivoted weight. Thus the pivoted beam typically extends in one direction to the weight and in another direction to a pin which cooperates with any suitable member. Typically the toy has at least one recess, which recess contains a pivoted member having a weighted bias, and the pin alternately displaces or releases the pivoted member of the recess, which recess typically is a simulated eye socket, i.e., the pivoted member of the recess is a simulated eyeball. The simulated eyeball is typically pivoted and weighted on a bias so that the simulated eyelid only opens when the pin is extended into the eye socket by the beam, and thus the pin spontaneously retracts and the eyelid closes when the beam ceases to exert force against the pin.

In a preferred embodiment, a time delay sequence is provided so that, e.g., the eyelid only opens slowly, typically over a 30 second time interval, because the beam only gradually displaces the pin into the eye socket. This simulates the gradual awakening of a toy doll when it is placed in the horizontal reclining position. In this case, the pivoted weight is movable to a first position without hindrance when the toy is in a first orientation, and the motion of the pivoted weight to a second position when the toy is in a second orientation is hindered by time delay means which permit gradual displacement of the pivoted weight to the second position over a finite time interval, e.g., 30 seconds. The time delay means preferably includes a flexible resilient bellows mounted on a rigid mounting, and a bleed valve and a flap valve. The bleed and flap valves are also mounted on the rigid mounting, with the flap valve controlling the passage of air into the bellows so that air can rapidly pass into the bellows when the bellows expands, with the flap valve being a one-way valve so that passage of air out of the bellows through the flap valve when the bellows contracts is precluded. The bleed valve controls the passage of air out of the bellows, so that air can only gradually pass out of the bellows when the bellows contracts. Typically the bellows contracts due to pressure of the pivoted weight when the toy is in the second orientation, and the bellows expands when the pressure of the pivoted weight is relieved when the toy is in the first orientation.

The bleed valve typically is a substantially cylindrical pin having an annular longitudinal flat section, with the substantially cylindrical pin extending through a circular opening in the rigid mounting. The pin preferably terminates with an enlargement within the enclosure formed by the bellows and the rigid mounting, which enlargement is generally juxtaposed with the rigid mounting. The enlargement typically is a disc-shaped cap coaxially aligned with the substantially cylindrical pin; generally in this case the rigid mounting is circular, the bellows is generally cylindrical, and the rigid mounting and the bellows are coaxially aligned with the cap and pin.

The present toy provides several salient advantages. Since different sounds are emitted at different orientations of the toy, a child derives a great deal of pleasure and enjoyment in playing with and manipulating the toy, since not only visual but also the aural senses are stimulated. Thus, the simulation of a living toy such as a doll is greatly enhanced. The toy thus appeals greatly to children of all ages, and serves to stimulate the mind processes of the child due to the relating in the child's mind of the position or orientation of the toy with a particular sound. When the toy is a doll the simulation of a real-life baby is such that the child feels, in a preferred embodiment of the toy, that the doll actually needs the child and wants to be picked up, held, and fondled or coddled, as described supra. Thus the toy provides a new sense of responsibility in the mind of a child. The toy employs components which are relatively inexpensive to fabricate and assemble, and the toy is of low cost and is durable and reliable in service. Finally, the toy provides a sense of companionship to a child playing alone, such as a child with no siblings in the family.

The invention consists in the features of construction, combination of elements, and arrangement of parts which will be exemplified in the article of manufacture hereinafter described and of which the scope of application will be indicated in the appended claims.

BRIEF DESCRIPTION OF THE DRAWINGS

In the accompanying drawings in which is shown one of the various possible embodiments of the invention.

DETAILED DESCRIPTION OF THE PREFERRED EMBODIMENTS

Figure 1:
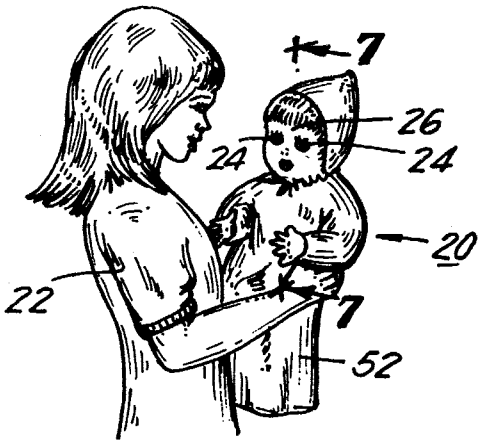
FIG. 1 is a perspective view showing a child holding the toy, in this case a doll, in the upright vertical position.
Figure 2:
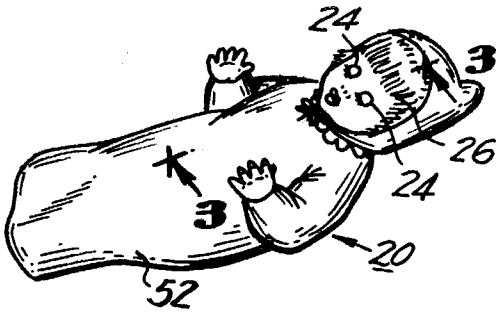
FIG. 2 shows the doll when first placed in the reclining horizontal position.
Figure 3:
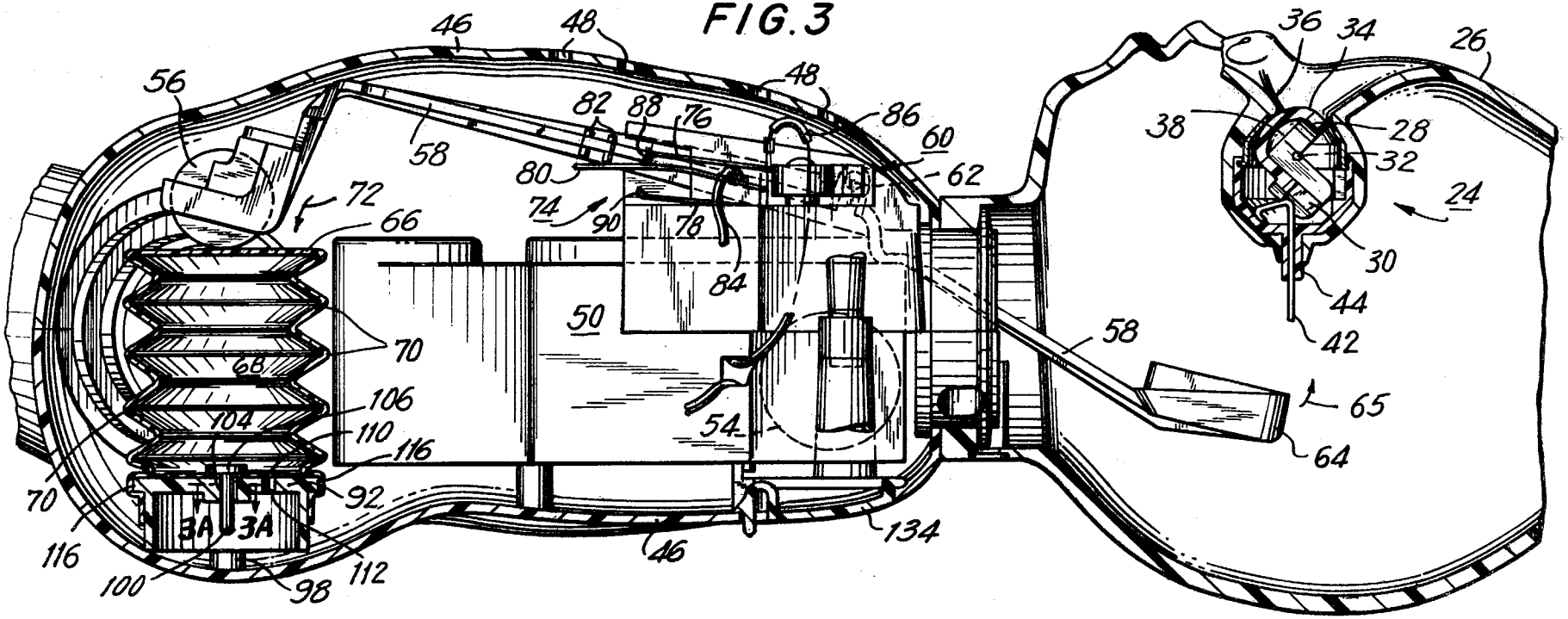
FIG. 3 is a sectional elevation view taken substantially along the line 3—3 of FIG. 2 and showing the disposition of the internal elements of the doll when first placed in the horizontal position.
Figure 4:
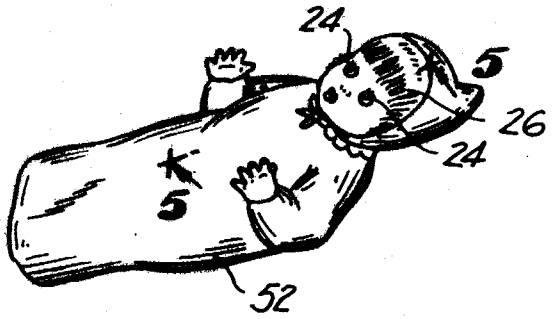
FIG. 4 shows the doll after a time interval in the horizontal position.
Figure 5:
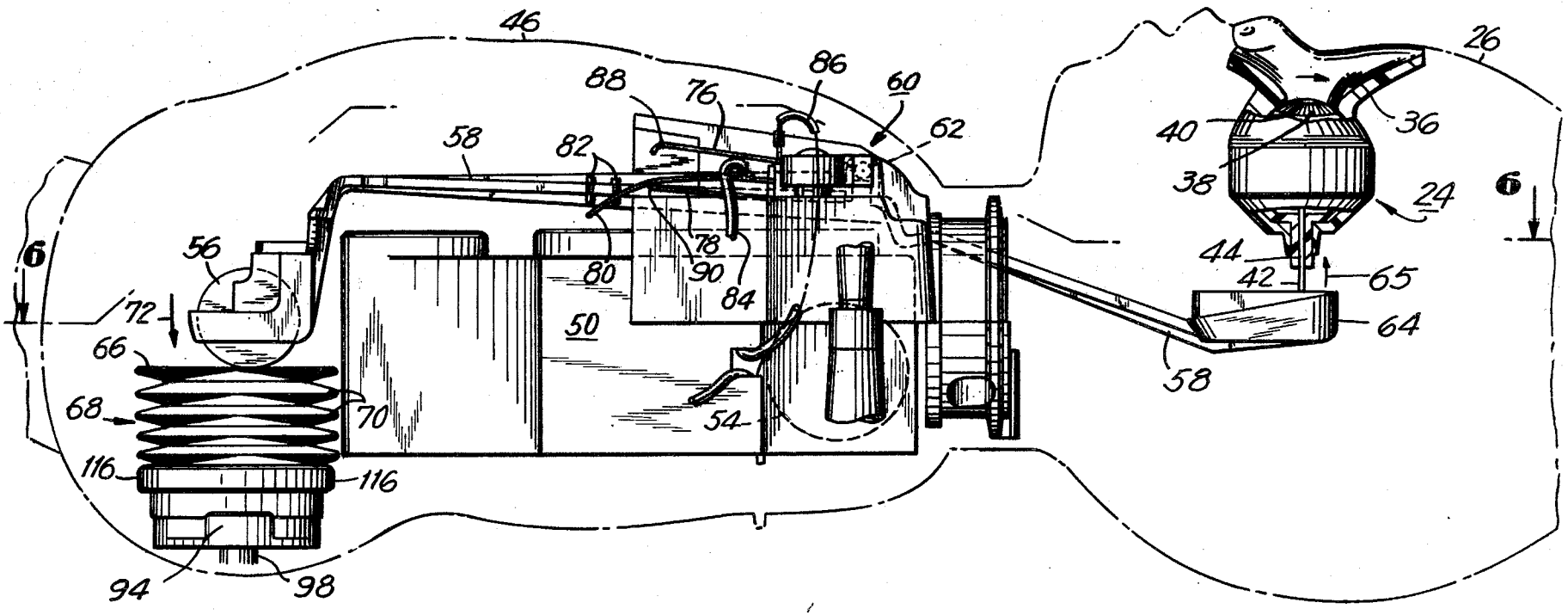
FIG. 5 is a sectional elevation view taken substantially along the line 5—5 of FIG. 4 and showing the disposition of the internal elements of the doll after a time interval in the horizontal position.

Referring now to FIGS. 1, 2 and 3, the doll 20 of FIG. 1, initially held vertically upright by the child 22 in FIG. 1, has just been placed by the child 22 on a horizontal surface in FIG. 2, so that, inter alia, eyes 24 in the doll head 26, which were initially open, are now closed in FIG. 2. The internal structure of an eye 24 is shown in FIG. 3. The movable portion of the eye 24 basically consists of a pivoted member having a front portion 28, a weighted rear portion 30, and a central pivot axis 32. The front portion 28 is provided with simulated eyelid 34, simulated eyelashes 36 and a simulated eyeball 38 with pupil 40 (FIG. 5). A rear pin 42 mounted in a sleeve 44 at the rear of the eye 24 serves to displace the elements 28 and 30 in a generally arcuate path about the pivot mounting axis 32, when the pin 42 is displaced forwards, as will appear infra, whereupon the eye will open.

FIG. 3 shows details of the internal structure of the invention in doll torso 46, which is a foraminous enclosure, being provided with a plurality of front openings 48, so that a sound emitted by a means 50 to alternately emit at least two different sounds may readily emanate from the interior of the torso 46 through the outer garment 52 of the doll (FIGS. 1 and 2) to the outside of the doll and thus be heard by a child. The means 50 in this embodiment of the invention is of a configuration and structure as described in U.S. Pat. Nos. 3,467,393 and 3,589,735 and Japanese Pat. No. 793,915, and is powered by a battery 54.

A weight 56 is pivoted by being attached to a beam 58 which extends to a pivotal mounting 60 having an axle 62. The beam 58 extends upwards from the pivot point or mounting 60 to a paddle 64 which, as will appear infra, moves in an arcuate path indicated by arrow 65 towards pin 42 and then forces pin 42 into sleeve 44 and against the weighted section 30 so as to force the eye 24 to open. The weight 56 rests upon the top section 66 of a generally cylindrical bellows 68 which is composed of a flexible and resilient material such as natural or synthetic rubber, e.g., neoprene, buna or the like or such as a resilient plastic, e.g., certain types of polyethylene, polypropylene, etc. The corrugations 70 in bellows 68 permit the compression and ultimate collapse of the bellows 68 as the weight 56 pivots about axle 62 and bears down against the top section 66 in the direction generally indicated by the arrow 72.

Immediate total compression and collapse of the bellows 68 is prevented by the provision of air egress time delay means, so that the compression of the bellows 68 is gradual. This provides a finite time interval, e.g. 30 seconds, during which the beam 58 slowly pivots about pivot means 60. Thus when the child first places the doll in a reclining horizontal position as shown in FIGS. 2 and 3, e.g., into a toy crib, the eyes 24 do not immediately open, since paddle 64 only moves slowly towards pin 42. Ultimately, after the time interval has elapsed and a position is achieved which is shown in FIG. 5, the bellows 68 is totally collapsed and the paddle 64 has moved against and displaced the pin 42 slowly forwards and into the eye 24 from the rear, so that the eye is gradually opened to a fully open position.

Concomitantly, the audible sound emitted by the doll changes from e.g. giggling, to crying. This is accomplished by the provision of switch means 74 in conjunction with the beam 58. The switch means 74 in this embodiment of the invention is characterized by the provision of a first pole 76, a second pole 78, and a spring-biased throw member 80. The member 80 is spring biased towards completion of a circuit with pole member 76, which results in the emanation of giggling from the doll means 50. This occurs when the doll is in the upright position and when a tab or tongue 82 on beam 58 does not press against throw member 80. In this case a circuit is completed via wire 84, throw member 80, pole 76 and wire 86; the wires 84 and 86 lead to the appropriate circuit in means 50 such that the sound of giggling or laughter is generated.

When the pivoted weight 56 starts to move downwards against surface 66, as in the FIG. 3 configuration, at the onset, beam 58 pivots about axle 62 and tongue 82 displaces throw member 80 away from contact with terminal tab 88 on pole 76, so that the circuit is broken, all sound ceases, and the throw member 80 moves in the space between tab 88 and the terminal tab 90 on pole 78, during the finite time interval of e.g. 30 seconds. When the motion of beam 58 is finally completed as shown in FIG. 5, tongue 82 has displaced throw member 80 into a contact with tab 90 of pole 78, so that an alternate circuit to means 50 is completed and the doll commences to cry, i.e., the audible sound of crying emanates from means 50. The crying sound will continue until the doll is picked up and again held vertically, as will appear infra. Concomitantly with the onset of crying, as discussed supra, the eye 24 has opened to the fully open position, and thus the simulation of a baby, in the reclining position, who has awakened, opened its eyes and started to cry, is complete.

Figure 3A:
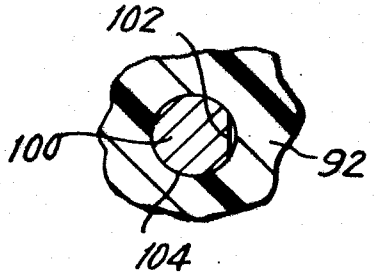
FIG. 3A is a partial sectional plan view taken substantially along the line 3A—3A of FIG. 3.

A typical time delay means of the invention is illustrated in FIGS. 3 and 3A. As mentioned supra, the time delay means functions by the gradual egress of air from bellows 68, so that the bellows 68 only gradually compresses and deforms to the collapsed state under the influence of weight 56 pressing against top section or surface 66 of the bellows. This is accomplished in this embodiment of the invention by mounting bellows 68 on a rigid circular mount 92 which in turn is mounted to the inner torso of the doll on lateral arms 94 which extend and are attached by screws 96 (FIG. 6), to inner pedestals 98 integral with the doll torso 46. It will be appreciated that similar mountings are provided for the other inner appurtenances of the doll, such as e.g. means 50. In any event, the time delay means includes structural elements in conjunction with mounting 92, consisting in this embodiment of the invention of a bleed valve mounted to mounting 92, for controlled egress of air from bellows 68 through mounting 92. The bleed valve preferably consists of a central substantially cylindrical pin 100 having an annular longitudinal flat section 102 for controlled egress of air, which pin 100 extends through a central circular opening 104 in the rigid mounting. Thus, as best shown in FIG. 3A, a minute passage of controlled dimension, for air egress, is defined between the flat edge of section 102 and the arcuate edge of opening 104. The pin 100 is integral with an enlargement within the enclosure formed by the bellows 68 and the rigid mounting 92, which enlargement holds the pin 100 in position and consists in this embodiment of the invention of a disc-shaped cap 106 coaxially aligned with the pin 100; the circular rigid mounting 92 and the cylindrical bellows 68 are coaxially aligned with the cap 106 and the pin 100.

Figure 7:
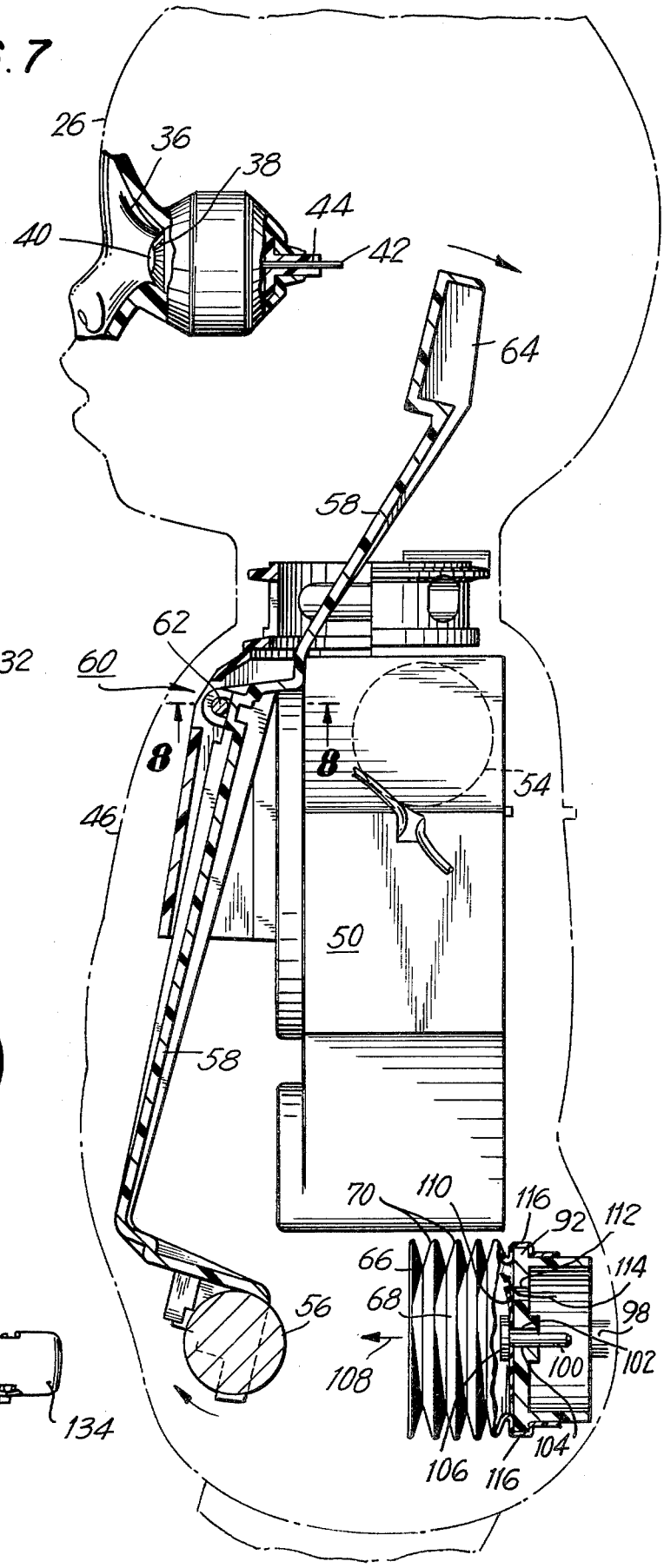
FIG. 7 is a sectional elevation view taken substantially along the line 7—7 of FIG. 1 and showing the disposition of the internal elements of the doll when grasped by a child and held in the upright vertical position.

Further structure is provided in conjunction with mounting 92, so that air may gush into bellows 68 as it deforms back and assumes a fully extended configuration, when the doll is picked up and held vertically by the child 22. As best shown in FIG. 7, the instant the doll is picked up and held vertically, pivoted weight 56 immediately swings on the beam 58 so that pressure on bellows 68 ceases to exist. The contracted corrugations 70 immediately begin to exert a force, in a direction indicated by the arrow 108, so as to distend the bellows 68 to a fully extended position. In order to permit air to gush into bellows 68, which obviously could not occur through or via the bleed valve described supra, due to the very restricted orifice of the bleed valve, a one-way flap valve is also provided in conjunction with rigid mounting 92. The flap valve controls the passage of air into the bellows 68 so that air can rapidly pass into the bellows 68 when it expands, with the flap valve being a one-way valve so that passage of air out of the bellows 68 through the flap valve, when the bellows 68 contracts, is precluded. The flap valve basically includes a disc-shaped flexible resilient flap member 110 mounted between cap 106 and mounting 92, together with a small hole or opening 112 in the rigid mounting within the perimeter of the flap member 110. Thus, as best seen in FIG. 7, the flap valve permits rapid one-way flow of a gushing stream 114 of air into the bellows 68 when it expands and moves in the direction of arrow 108, while as shown in FIG. 3, when the bellows is contracting, flap member 110 presses against mounting 92 and effectively closes off hole 112 against air flow. The annular mounting 116 of bellows 68 on the rigid disc-shaped or circular mount 92 also precludes annular air flow into or out of the bellows 68.

Figure 6:
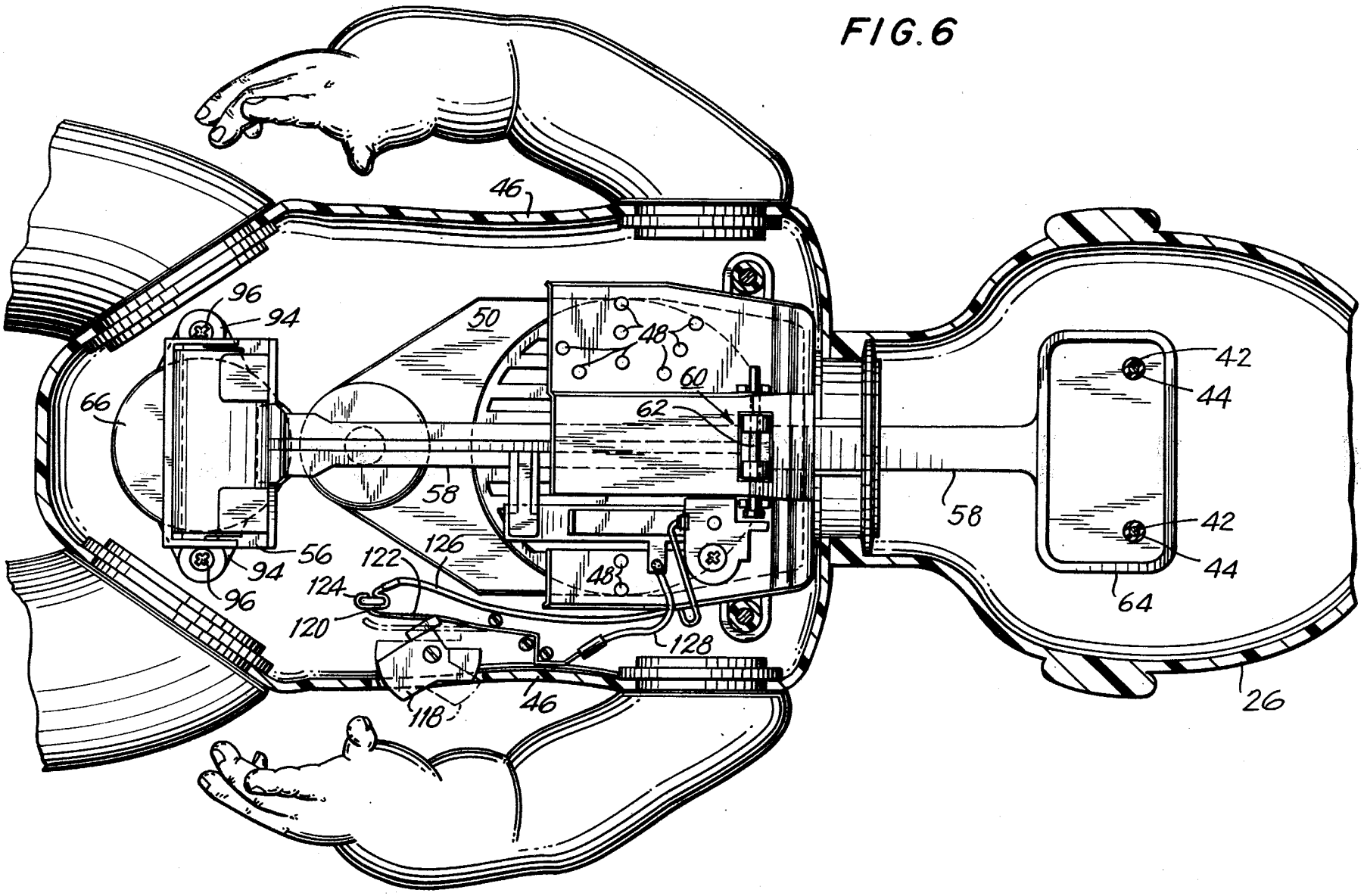
FIG. 6 is a front elevation view of the doll showing internals of the doll.
Figure 9:
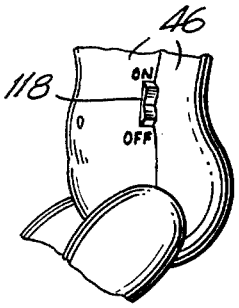
FIG. 9 shows the orientation of the external switch which controls the actuation of the internal electrical circuit which in turn actuates the means to alternately emit two different sounds.

It will be apparent from the foregoing that some means must be interposed, in this embodiment of the invention, to shut off the means 50 when the doll is not being played with. FIG. 6 shows a typical means for this purpose, consisting of an on-off switch 118, which when in the on position as shown by the full lines, forces the end 120 of a flexible spring-like electric current transfer member 122 against a junction contact 124, so that an electric circuit is completed between wires 126 and 128, which permits electric current to flow through wires 126 and 128 and from the battery to the means 50. The phantom outline of elements 118 and 120 in FIG. 6 indicates the off position of the switch 118, at which time the end 120 of current transfer member 122 is spaced from contact 124. The orientation of the switch 118 at the side of the torso 46 in the assembled doll is shown in FIG. 9.

Figure 8:
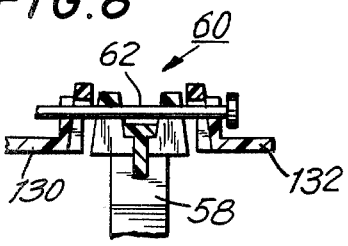
FIG. 8 is a bottom partial sectional plan view taken substantially along the line 8—8 of FIG. 7.
Figure 10:
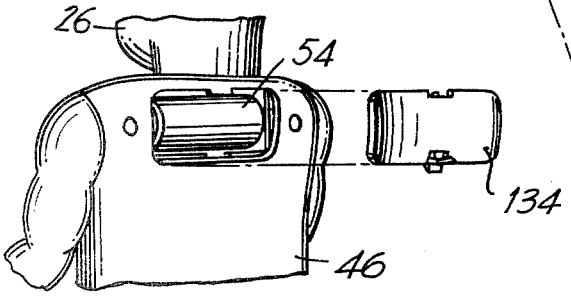
FIG. 10 shows the disposition and mounting of a battery in the upper back of the doll, which battery provides the electrical motive power to run the means to alternately emit the two different sounds.

FIG. 8 shows details of the pivotal mounting 60 of the beam 58. Support elements 130 and 132 extend from the torso 46 to hold and support the ends of the axle 62. FIG. 10 shows the mounting of the battery 54 in the upper rear of the torso 46. A cover plate 134 snaps into place to conceal the battery 54. A cross-sectional detail of the configuration of this cover plate 134 is shown in FIG. 3. Finally, the joints between the arms, legs or head 26 and the torso 46 have been shown to some extent in FIGS. 3, 6 and 7. These joints are of the usual configuration for dolls and will not be described in detail, in the interest of brevity. Likewise, the mounting of inner appurtenances such as means 50 to the torso 46 have been shown to some extent, however, these mountings will not be described in detail; they are similar to the mounting of member 92 to the torso as described supra.

It thus will be seen that there is provided an audible sound emitting toy which achieves the various objects of the invention and which is well adapted to meet the conditions of practical use.

As various possible embodiments might be made of the above invention, and as various changes might be made in the embodiment above set forth, it is to be understood that all matter herein described or shown in the accompanying drawings is to be interpreted as illustrative and not in a limiting sense. Thus, it will be understood by those skilled in the art that although preferred and alternative embodiments have been shown and described in accordance with the Patent Statutes, the invention is not limited thereto or thereby.

Having thus described the invention, there is claimed as new and desired to be secured by letters patent:

1. A doll capable of emitting different sounds in each of at least two orientations of which a first orientation of the doll is an upright vertical position and a second orientation of the doll is a reclining horizontal position comprising an enclosure constituting at least a portion of the doll and having a hollow interior and a foraminous portion communicating said interior with the exterior of the doll; means in said hollow interior for emitting sounds, including at least two sections each operative for emitting the sounds associated with one of the orientations; and means for controlling the operation of said emitting means in dependence on the orientation of the doll, including a weight so mounted in said hollow interior as to be gravitationally displaced toward a different position relative to said enclosure in each of the orientations, switch means including a control portion attached to said weight for movement therewith and operative for energizing a different one of said sections of said emitting means in each of said positions of said weight, and time-delay means for retarding the displacement of said weight toward at least one of said positions thereof and for delaying the energization of the corresponding section of the emitting means upon change of the orientation of the doll by a finite time interval, said emitting means simulating sounds of giggling when the doll is in the upright vertical position and crying when in the reclining horizontal position.

2. The doll of claim 1 in which the enclosure is the torso of the doll.

3. The doll of claim 1 in which the weight is mounted on a pivoted beam.

4. The doll of claim 3 in which the pivoted beam extends in one direction to the weight and in another direction to a pin.

5. The doll of claim 4 in which the doll has at least one recess, said recess containing a pivoted member having a weighted bias, and the pin alternately displaces said pivoted member when the pin is extended, or releases the pivoted member when the pin is retracted.

6. The doll of claim 5 in which the recess is a simulated eye socket and the pivoted member is a simulated eyeball.

7. A toy capable of emitting a plurality of audible sounds, each sound corresponding to a different orientation of the toy, which comprises an enclosure, said enclosure being at least a portion of said toy, at least a portion of the interior of said enclosure being hollow, at least a portion of said enclosure adjacent the hollow interior portion being foraminous, means within the hollow interior portion of said enclosure to alternately emit at least two different audible sounds, and a pivoted weight and switch means within the hollow interior portion of said enclosure, said switch means being connected with said pivoted weight and with said means to alternately emit at least two different audible sounds, said pivoted weight moving to alternate positions when the orientation of the toy is changed so that a change in the relative position of said pivoted weight causes said switch means to controllably change the audible sound emitted by said means to alternately emit at least two different audible sounds, said pivoted weight being movable to a first position without hindrance when the toy is in a first orientation, and the motion of the pivoted weight to a second position when the toy is in a second orientation is hindered by time delay means, said time delay means permitting gradual displacement of the pivoted weight to the second position over a finite time interval and including a flexible resilient bellows mounted on a rigid mounting, and a bleed valve and a flap valve, said bleed and flap valves being mounted on said rigid mounting, said flap valve controlling the passage of air into said bellows so that air can rapidly pass into said bellows when said bellows expands, said flap valve being a one-way valve so that passage of air out of said bellows through said flap valve when said bellows contracts is precluded, said bleed valve controlling the passage of air out of said bellows so that air can only gradually pass out of said bellows when said bellows contracts.

8. The toy of claim 7 in which the bellows contracts due to pressure of said pivoted weight when the toy is in the second orientation and the bellows expands when the pressure of said pivoted weight is relieved when the toy is in the first orientation.

9. The toy of claim 7 in which the bleed valve is a substantially cylindrical pin having an annular longitudinal flat section, and said substantially cylindrical pin extends through a circular opening in the rigid mounting.

10. The toy of claim 9 in which the substantially cylindrical pin terminates with an enlargement within the enclosure formed by the bellows and the rigid mounting, said enlargement being juxtaposed with the rigid mounting.

11. The toy of claim 10 in which the enlargement is a disc-shaped cap coaxially aligned with the substantially cylindrical pin, the rigid mounting is circular, the bellows is generally cylindrical, and the rigid mounting and the bellows are coaxially aligned with the cap and pin.

* * * * *